United States Patent [19]

Hensley et al.

[11] Patent Number: 4,526,700

[45] Date of Patent: Jul. 2, 1985

[54] HYPOCHLORITE BLEACH COMPOSITIONS CONTAINING OPTICAL BRIGHTENERS

[75] Inventors: Charles A. Hensley; David J. Kitko, both of Cincinnati, Ohio

[73] Assignee: The Procter & Gamble Company, Cincinnati, Ohio

[21] Appl. No.: 649,457

[22] Filed: Sep. 11, 1984

Related U.S. Application Data

[63] Continuation-in-part of Ser. No. 549,333, Nov. 4, 1983, abandoned.

[51] Int. Cl.[3] ..... C11D 3/42; C11D 3/28; C11D 7/54

[52] U.S. Cl. ..... 252/102; 252/94; 252/95; 252/187.26; 252/543; 252/DIG. 14; 252/174.11

[58] Field of Search ..... 252/94, 95, 102, 543, 252/187.26, DIG. 14, 301.29

[56] References Cited

U.S. PATENT DOCUMENTS

| | | | |
|---|---|---|---|
| 3,393,153 | 7/1968 | Zimmerer et al. | 252/95 |
| 3,655,566 | 4/1972 | Robinson et al. | 252/98 |
| 3,767,587 | 10/1973 | Claussen et al. | 252/301.2 |
| 3,904,544 | 9/1975 | Clark et al. | 252/301.2 |
| 3,962,115 | 6/1976 | Clark et al. | 252/301.23 |
| 4,071,463 | 1/1978 | Steinhauer | 252/103 |
| 4,271,030 | 6/1981 | Brierley et al. | 252/98 |
| 4,282,109 | 8/1981 | Citrone et al. | 252/102 |
| 4,311,605 | 1/1982 | Eckhardt et al. | 252/102 |
| 4,390,448 | 6/1983 | Boden et al. | 252/187.26 |

FOREIGN PATENT DOCUMENTS 63184 5/1977 Japan .

OTHER PUBLICATIONS

Bulletin–Phorwite BHC 766 (Mobay Chem. Corp.) Jun. 1980.

*Primary Examiner*—Prince E. Willis

*Attorney, Agent, or Firm*—Richard C. Witte; Ronald L. Hemingway

[57] ABSTRACT

Aqueous hypochlorite bleach compositions containing a fine dispersion of the bleach stable optical brightener 4,4′-bis(4-phenyl-2H-1,2,3-triazol-2-yl)-2,2′-stilbenedisulfonate.

15 Claims, No Drawings

HYPOCHLORITE BLEACH COMPOSITIONS CONTAINING OPTICAL BRIGHTENERS

RELATED APPLICATIONS

This application is a continuation-in-part of U.S. Ser. No. 549,333, filed Nov. 4, 1983, now abandoned.

FIELD OF THE INVENTION

The invention pertains to aqueous hypochlorite bleach products which contain optical brighteners, and to the process for making said products.

BACKGROUND ART

Sodium hypochlorite is a highly effective bleaching agent and has long been used in conjunction with soaps and detergents to remove stains and other types of soils in the laundering of fabrics. It is generally formulated at a concentration of about 4–8% in water for sale for household use, where it is typically diluted to a concentration of about 200 ppm sodium hypochlorite for laundry bleaching.

Optical brighteners are dyes which are absorbed by fabrics and impart to the fabric an added increment of whiteness/brightness by means of their ability to absorb invisible ultraviolet radiation and re-emit it as visible radiation. Optical brighteners have been included as a component in laundry products for many years.

Most optical brighteners are subject to chemical attack by hypochlorite in solution, and their brightening effect is considerably diminished when used in conjunction with hypochlorite in laundering of fabrics. However, some optical brighteners have been developed which are highly resistant to hypochlorite attack.

It is desirable to formulate concentrated (typically about 4–8%) sodium hypochlorite solutions which contain bleach stable optical brighteners. Thus, if the housewife uses bleach in conjunction with a detergent which contains a brightener which is not stable to hypochlorite, a fabric brightening effect will still be obtained from the brightener present in the bleach.

Optical brighteners are generally insoluble in concentrated hypochlorite, and tend to quickly settle to the bottom of an aqueous hypochlorite product. Thus, simple addition of optical brightener to concentrated aqueous hypochlorite results in a product which must be vigorously shaken each time before use. Because of the tendency for rapid settling, even vigorous shaking before each use does not necessarily always result in the obtaining of uniform proportions of brightener and hypochlorite in each use. U.S. Pat. No. 3,393,153, Zimmerer, issued July 16, 1968, presents a solution to this problem by including in the composition a particulate material such as colloidal silica or a particulate colloidal polymeric resin which keeps the optical brightener in suspension in aqueous hypochlorite.

It is an object of the present invention to prepare aqueous compositions containing hypochlorite and finely suspended optical brighteners, without the use of added particulate colloidal materials to provide brightener suspension.

SUMMARY OF THE INVENTION

The present invention is directed to the formulation of aqueous sodium hypochlorite compositions containing a fine dispersion of a bleach stable optical brightener. The compositions comprise from about 3% to about 8% sodium hypochlorite, from about 0.025% to about 0.2% of the optical brightener, 4,4'-bis(4-phenyl-2H-1,2,3-triazol-2-yl)-2,2'-stilbenedisulfonate, from about 0.05% to about 2% of certain alkylaryl sulfonate surfactants, and water. The optical brightener is present in the composition in the form of a dispersion of fibrous particles having diameters of from about 0.01 to about 1.5 microns.

DETAILED DESCRIPTION OF THE INVENTION

In accordance with the present invention it has been found that the bleach stable optical brightener 4,4'-bis(4-phenyl-2H-1,2,3-triazol-2-yl)-2,2'-stilbenedisulfonic acid (or its alkali metal salts) can be formulated into concentrated aqueous sodium hyopchlorite solution in a manner whereby the brightener is transformed into fibrous particles which have a density close to that of the aqueous phase. These fibrous particles, in which the fibers have a diameter of from about 0.01 to about 1.5 microns, settle very slowly. When settling does occur, the settled layer of particles is very loose and occupies a substantial volume of the composition. The settled layer of particles can be readily redispersed throughout the composition by gentle shaking of the bottle or other container from which the composition is to be dispensed.

The compositions of the invention comprise:

(a) from about 3% to about 8% sodium hypochlorite;

(b) from about 0.025% to about 0.2% of the optical brightener;

(c) from about 0.05% to about 2% of a surfactant selected from the group consisting of alkylaryl sulfonates having the formulas:

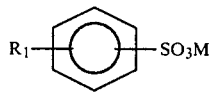

and

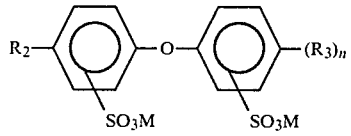

wherein $R_1$ is a $C_8$–$C_{20}$ alkyl group, $R_2$ and $R_3$ are $C_6$–$C_{16}$ alkyl groups, M is alkali metal and n is 0 or 1; and (d) at least about 80% water; wherein the brightener is present in the composition in the form of fibrous particles having fiber diameters of from about 0.01 to about 1.5 microns.

All percentages herein are "by weight" unless specified otherwise.

The fibrous particles can be formed by co-precipitating ("salting out") the brightener and the surfactant in aqueous hypochlorite. This can be done by dissolving the brightener and surfactant in water and then adding aqueous sodium hypochlorite to this solution, thereby causing formation of the desired fibrous particles.

Sodium Hypochlorite

Typically, sodium hypochlorite is commercially available in aqueous solutions having a concentration of from about 5% to about 15%. These solutions typically contain an equimolar amount of sodium chloride. In making the compositions of the present invention it is generally desirable to add sodium hypochlorite solution to the brightener/surfactant solution in volumes such that the volume of sodium hypochlorite will be from about 0.4 to about 8 times the volume of the brightener/surfactant solution. Accordingly, the aqueous sodium hypochlorite source chosen for preparing a composition of the invention should be one which has a sodium hypochlorite concentration such that it can be mixed with the aqueous brightener/surfactant solution within these volume proportions to produce the desired amounts of sodium hypochlorite, brightener and surfactant in the finished product.

Sodium hypochlorite is present in the compositions of the invention at levels of from about 3% to about 8%, preferably from about 4% to about 6%.

Brightener

The brightener used in the compositions herein is 4,4'-bis(4-phenyl-2H-1,2,3-triazol-2-yl)-2,2'-stilbenedisulfonic acid, or its alkali metal (e.g., sodium or potassium) salts. The structure of the sodium salt is:

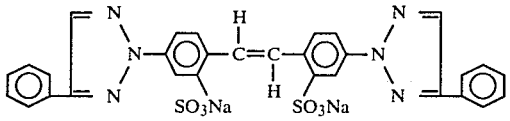

This optical brightener is available from Mobay Chemical Corporation, a subsidiary of Bayer AG, under the name Phorwite$^R$ CNA.

The optical brightener is present in the composition of the invention at levels of from about 0.025% to about 0.2%, preferably from about 0.05% to 0.2%, and most preferably from about 0.05% to about 0.075%.

Surfactant

The surfactants used in the present invention are selected from the group consisting of alkylaryl sulfonates having the formulas:

1. 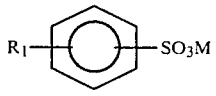

2. 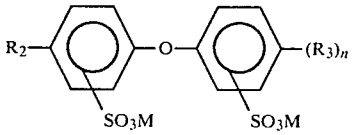

wherein $R_1$ is an alkyl group of from 8 to 20 (preferably 11 to 13) carbon atoms, $R_2$ and $R_3$ are alkyl groups of 6 to 16 (preferably 10–12) carbon atoms and M is an alkali metal, e.g., sodium or potassium, and n is 0 or 1.

Surfactants of formula 1 are called alkylbenzene sulfonates and are available under various tradenames, e.g., Calsoft$^R$ L-60, F-90 and L-40 from Pilot Chemical Company, and Naccanol$^R$ 35SL and 90F from Stepan Chemical Company.

Surfactants of Formula 2 are alkyl diphenyloxide sulfonates and are available under the Dowfax$^R$ name from Dow Chemical Company.

The surfactants are present in the compositions herein at levels of from about 0.05% to about 2.0%, preferably from about 0.2% to about 1.0%.

Presence of surfactant in the compositions of the invention has been found to be essential to creating the desired fibrous particles of brightener. If surfactant is not used, the brightener precipitates as larger size flocculent aggregates, having a size of from about 100 microns to about 300 microns. These larger particles, although bouyant enough to provide dispersion of the precipitated brightener in hypochlorite solution, have the appearance of curd and render the product less appealing from an aesthetic standpoint. Also the presence of surfactant tends to increase the chemical stability of the precipitated brightener against attack by hypochlorite during storage of the composition.

Perfumes

Optionally, perfumes can be present in the compositions of the invention at levels of from 0% to about 0.5%, preferably from about 0.05% to about 0.3%. The perfume materials used should, of course, have a high degree of chemical stability to sodium hypochlorite. Some preferred materials for use as perfume ingredients in the compositions herein are patchouli oil, cyclopentadecanolide, p-tertiarybutyl cyclohexyl acetate, tetrahydromycenol, tetrahydrolinalool, phenylacetaldehyde dimethylacetal, methylphenyl carbinol, and mixtures thereof.

Some perfume materials have been found to function as antifoamants for the compositions herein, thereby facilitating processing and high-speed packing of the compositions. Examples of such perfume materials are:

2,6-dimethyloctan-2-ol,
3,7-dimethyloctan-3-ol,
2,6-dimethylheptan-2-ol,
2,4,4-trimethylpentan-2-ol,
2,4,4,6,6-pentamethylheptan-2-ol,
1-methyl-4-isopropylcyclohexan-8-ol,
4-tertiarybutylcyclohexyl acetate,
4-tertiarypentylcyclohexyl acetate,
diethylphthalate,
phenylacetaldehyde dimethyl acetal, and mixtures therof.

When perfumes are used in the compositions herein they are preferably mixed into the solution of brightener and surfactant prior to the addition of aqueous sodium hypochlorite to the solution.

If perfume usage is toward the upper end of the usage range (i.e., 0.3% to 0.5%) then it is usually necessary to use an amount of surfactant which is also at the higher end of the 0.05% to 2% surfactant usage range hereinbefore disclosed.

Presence of perfume tends to improve the dispersion of fibrous particles in the hypochlorite, i.e., the dispersion tends to have better physical stability when perfume is present.

Organic oils other than those mentioned under examples of perfume materials can also be used in order to mask the chlorine smell. A preferred organic oil is linear alkylbenzene (LAB) having alkyl chains of from 10 to 14 carbon atoms.

Pigments such as Ultramarine Blue can also be added to the compositions if desired.

Composition Preparation

The compositions of the invention can be prepared by:

1. Preparing an aqueous solution containing from about 0.05% to about 0.4% of the brightener and from about 0.1% to about 4% of the surfactant;
2. Adding slowly, and with low shear mixing, to the solution of Step 1, a sufficient amount of aqueous sodium hypochlorite to produce a final composition comprising from about 3% to about 8% sodium hypochlorite, from about 0.025% to about 0.2% brightener and from about 0.05% to about 2% surfactant.

If perfume is to be used in the composition, it is added to the aqueous solution of brightener and surfactant (Step 1) at a level up to about 1%.

The aqueous solution of brightener (Step 1) is preferably prepared with deionized water. This minimizes the presence of heavy metal ions, which tend to cause decomposition of sodium hypochlorite. It also minimizes the presence of ions such as $Ca^{2+}$ and $Mg^{2+}$ which tend to precipitate the brightener before the brightener solution is mixed with hypochlorite. Depending on the level of brightener used, heating of the solution may be necessary to get all of the brightener into solution. If perfume is used, it is added after surfactant has been added. High levels of perfume generally require surfactant usage to be at the high end of the above stated concentration range.

When adding concentrated sodium hypochlorite to the aqueous brightener/surfactant solution of Step 1 (which may or may not contain perfume) the hypochlorite should be added slowly and with gentle mixing. The rate of addition should be sufficiently slow to allow maintenance of a substantially uniform distribution of hypochlorite throughout the solution, notwithstanding the gentle mixing. As the hypochlorite is added, the fibrous particles of brightener will quickly form. The formation of these particles will be complete well before all of the sodium hypochlorite has been added. Mixing should be gentle throughout the addition of the hypochlorite. High shear mixing and other forms of mixing which produce a high degree of agitation should be avoided since they will lead to formation of larger particles which have poorer suspension properties in the solution, and which are more difficult to redisperse after settling to the bottom of the composition. The dispersion of this invention is best described as made of a network of hair-like fibers (i.e., fibrous particles) mainly consisting of the brightener, as evidenced by fluorescent microscopy study. Since both the brightener and surfactant are co-precipitated ("co-salted out"), the fibrous particles may also contain surfactant. Chemical characterization showed that the brightener and the surfactant (also perfume and pigment, if they are present) exist almost entirely in the dispersed phase, the continuous phase being the aqueous sodium hypochlorite.

In the compositions made in accordance with this invention, the particles of brightener will typically remain more or less homogeneously suspended in the compositions for several days. Even after the composition eventually becomes nonhomogeneous, most of the particles do not settle to the bottom of the composition, but remain suspended in the bottm one third to two thirds of the composition volume. With a very minor amount of agitation (such as by inverting a bottle and returning it to its upright position) a homogeneous dispersion of the particles throughout the entire composition volume is quickly restored. Thus, the present invention provides compositions whereby consistent dosages of a combination of sodium hypochlorite and optical brightener in a concentrated aqueous medium can be easily obtained.

For best chemical stability, the compositions herein should have a pH above 12, preferably about 12.5. The pH of the composition should be tested after preparation is complete. If needed, pH adjustment can be made with acid or base (e.g., HCl or NaOH).

In contrast to the composition of U.S. Pat. No. 3,393,153, Zimmerer, the compositions herein can be substantially free of undissolved particles, other than the precipitated brightener and surfactant.

The invention will be illustrated by the following examples.

EXAMPLE I

Hypochlorite Addition to Brightener vs. Brightener Addition to Hypochlorite

This example illustrates the importance of adding sodium hypochlorite solution to a brightener solution, rather than vice versa, in making compositions of the invention.

A brightener solution (500 ml) containing 0.1% Phorwite$^R$ CNA and 1.0% surfactant (Calsoft$^R$ F-90) was placed in a 2 liter beaker on a magnetic stirrer and mixed at a moderate speed. Sodium hypochlorite concentrate (440 ml, 12.6% $AvCl_2$, 13.2% NaOCL) was diluted to 500 ml with deionized water and then added via a dropping funnel at a metered rate over 15 minutes to the stirred brightener solution. A fine, lemon yellow dispersion of precipitate had formed when about 20% of the bleach solution had been added. After five days storage at ambient conditions the dispersion continued to occupy 50% of the volume of solution and is readily redispersed by turning the container upside down and returning it to an upright position. (Resulting product composition: 5.8% NaOCl, 0.05% brightener, 0.5% surfactant.)

When addition is carried out in the reverse manner, i.e., brightener solution added to a mixed NaOCl solution, larger particles are formed which more rapidly settle, e.g., after 4 hours the dispersed particles only occupy 25% of the total volume, and they are more difficult to redisperse (typically requires shaking for uniform redispersion).

Very rapid addition of the hypochlorite solution to a moderately stirred or even rapidly stirred solution also results in larger particles which more rapidly settle.

EXAMPLE II

Impact of Some Mixing Variables

A series of products was prepared with mixing conditions being the primary variable. The brightener solution had the same composition in all examples and consisted of 500 ml of solution containing 0.1% Phorwite$^R$ CNA, 0.5% surfactant (Calsoft$^R$ F-90), and in one example 0.3% perfume in addition. The hypochlorite concentrate (500 ml, 11.5% NaOCl) was metered in at controlled rates to the brightener solution in a baffled, 2 liter beaker, stirred by a Lightnin Mixer$^R$ equipped with a 6-bladed turbine agitator rotated at specified revolutions per minute (rpm). The table below records the observations made:

TABLE 1

| Mixing Speed (rpm) | NaOCl Addition Time | Precipitate Appearance | Time to Visible Separation | Precipitate Volume* |
|---|---|---|---|---|
| 125 | 15 min. | large flocs, lemon yellow | 15 min. | 50% |
| 170 | 15 min. | fine dispersion, lemon yellow | 12 hrs. | 50% |
| 350 | 15 min. | fine dispersion, lemon yellow | 12 hrs. | 60% |
| 880 | 15 min. | large flocs, foaming, lemon yellow | 10 min. | 10% |
| 350** | 15 min. | fine dispersion, lemon yellow | >24 hrs. | 95% |
| 350 | 20% at 3 min. 100% at 3.5 min. | fine dispersion, lemon yellow | 12 hrs. | 60% |

*Volume of the composition occupied by the precipitate after 1 week, ambient conditions
**with perfume These experiments indicate that formation of a stable, fine dispersion requires:

(1) sufficient agitation to uniformly mix the hypochlorite solution into the brightener solution during precipitation;

(2) once precipitation is nearly complete, addition of bleach can occur at more rapid rates without destabilizing the system.

(3) high speed mixing during precipitation can destabilize the system. This apparently occurs by causing additional agglomeration of the particles which results in more rapid settling.

Additional experiments using a variety of techniques known in the art of forming dispersions, emulsions, and microemulsions (e.g., homogenizers, high shear mixers, etc.) were investigated for preparing "brightener in hypochlorite dispersions." In all cases they generated flocs or aggregates with very poor stability, i.e., rapid sedimentation was observed.

EXAMPLE III

This example illustrates the making of a 35 gallon (132 liter) batch of a composition of the invention, containing perfume.

The steel shaft and folding 2 inch (5 cm) blades on a variable speed, air driven agitator (Eastern Mixers Co., Catalog #5200, Model BA-3) were replaced with sodium hypochlorite-resistant titanium replicas. The agitator motor was then mounted atop a 55 gallon (208 liter) polyethylene, closed head drum by placing the titanium shaft and blades through one of two 2 inch (5 cm) threaded buttress holes in the top of the drum and sealing the opening with a threaded fitting which supported the agitator motor and shaft. In such a position, the blades, when moving were approximately 5 inches (12.7 cm) from the bottom of the drum and came within about 2 inches (5 cm) of the side of the drum. The drum and agitator assembly were placed on a floor scale, and 75 pounds (34 kg) of 148° F. (64° C.) city water was added to the drum through the second buttress hold using a polyethylene tube. Approximately 3 gallons (11.4 liters) of 148° F. (64° C.) city water was placed in a 5 gallon (19 liter) polyethylene bucket, and 79.38 grams of an optical brightener (Phorwite$^R$ CNA) was added to the hot water in the bucket and stirred with a large spatula to produce a fine dispersion of the brightener. This dispersed material was then poured into the drum containing 75 pounds (34 kg) of 148° F. (64° C.) water, using a large funnel. In order to dissolve the brightener, the contents of the drum were agitated by the air driven motor at an air pressure setting of 25 psi (1759 g/sq.cm), and additional 148° F. (64° C.) water was added such that the total weight of the material in the drum was about 115 pounds (52 kg). After about 5 minutes of agitation under these conditions, 441.0 grams of Calsoft$^R$ F-90 (90% active) powdered sodium linear alkylbenzene sulfonate (LAS) was added to the drum through the funnel. Following another 5 minutes of agitation, 75° F. (24° C.) city water was added such that the total weight of material in the drum was about 175 pounds (79.4 kg). At this point 238.21 grams of perfume was added to the drum. Additional 75° F. (24° C.) city water was added such that the total weight of the solution in the drum was 198.5 pounds 90 kg). The pH of the drum contents was measured and determined to be 8.7. At small amount of 50 percent aqueous sodium hydroxide was added to adjust the pH to 11.6.

A 25° F. (−3.9° C.) concentrated bleach solution containing 13.7 percent sodium hypochlorite was added to the brightener/surfactant/perfume solution in the drum (Highly concentrated hypochlorite is stored at low temperature to maintain stability). This was accomplished using a polypropylene-encased magnetic drive centrigual pump (Fisher Scientific Model MD-15T) and polyethylene tubing. A constant addition rate of 2 pounds (0.85 kg) of hypochlorite solution per minute was maintained using a polyvinyl chloride needle valve until 25 pounds (11.3 kg) of hypochlorite solution had been added to the agitated drum. Following addition of the first 25 pounds (11.3 kg), the remainder of the 151.5 pounds (68.7 kg) of hypochlorite solution was added at a rate of 4 pounds (1.8 kg) per minute. Hypochlorite addition was stopped when the total contents of the drum reached a weight of 350 pounds (158.8 kg). The pH of this prooduct mixture was then adjusted to pH 12.5 with additional sodium hydroxide. Product temperature was 77° F. (25° C.). The composition of the product was as follows: 5.9 percent sodium hypochlorite (plus an equimolar amount of sodium chloride which was present in the hypochlorite solution), 0.05 percent of the optical brightener, 0.25 percent LAS, 0.15 percent perfume, and the balance water.

Uniform samples were taken from the drum and observed. These samples contained a uniform dispersion composed of very small particles which were barely distinguishable upon close inspection, and gave the product the appearance of a continuous fluid. Some of these samples were placed in 10 cm tall sealed amber glass jars and stored under ambient conditions. After 5 days about 98% of the volume was a uniform opaque dispersion of the precipitated brightener and surfactant. About 2% of the volume was a clear layer at the top. Thus, the bulk of the composition had retained its uniform opaque appearance.

EXAMPLE IV

This example illustrates the making of a 400 gallon (1514 liter) batch of a composition of the invention, containing perfume and Ultramarine Blue pigment.

A Utensco Series CC, Model XCC-500 vertical cylindrical rotomolded high density linear polyethylene tank was used as the batch process making vessel. The tank was constructed at a minimum 5/16 inch (0.79 cm) thickness with a 45 inch (114.3 cm) diameter and 72 inch (182.9 cm) straight side and was provided with an open flat top and conical bottom. The 500 gallon (1892.5 liter) capacity tank was equipped with 4 equally spaced baffles to provide proper fluid motion. The tank was supported on a heavy duty carbon steel stand. The stand was designed to support not only the tank but also a center-mounted, top entering agitator on twin 4 inch (10.2 cm) steel channels.

Agitation was provided by a Lightnin$^R$ Series XL, Model XLQ-150B top-entering, heavy duty, fixed mounted agitator designed for open tank operation. The unit was equipped with a 1.5HP, 1750 RPM, totally enclosed electric motor suitable for operation on 460 volts, 60 cycle electric current. The lower mixer shaft was attached to the drive shaft by means of a rigid coupling below the agitator mounting surface. The modular base assembly was provided with a mounting plate for mounting on the tank support structure. The lower mixer shaft was constructed at 2 inch (5.1 cm) diameter×78 inch (198.1 cm) length as measured from the agitator mounting surface. The lower shaft was equipped with a single 30 inch (76.2 cm) diameter Lightnin$^R$ A310, 3 blade axial flow impeller of bolted blade construction. Stabilizing fins were provided to insure safe operation. The impeller was attached to the shaft by means of a keyway and a safety hook key arrangement. The keyway was 18 inches (45.7 cm) long with stops at 1 inch (2.5 cm) intervals.

All wetted parts were constructed of 316 stainless steel, while all nonwetted parts were made with the manufacturer's standard shop finish. The mixer shaft, the axial flow impeller, the stabilizing fins, and all wetted parts were assembled and were coated with successive applications of Kynar, a sodium hypochlorite-resistant material. A parametrics AC variable frequency motor speed controller was provided. The speed control unit was equipped with a 1.5 HP Parajust E power unit in a NEMA 4 enclosure. The power unit was provided with a remote operator station, 3 function, start/-stop/speed variation controller. A heavy duty speed reducer with double reduction helical gears was provided so maximum output speed was 153 RPM. An operating range of 15-153 RPM was provided by use of the speed controller unit.

Making

One hundred-fifty gallons (568 liters) of 148° F. (64° C.) city water was added by a water line through the top of the tank and was recirculated through a heat exchanger until it reached 155° F. (68° C.). Recirculation was stopped and 1.82 lbs. (0.83kg) of an optical brightener (Phorwite$^R$ CNA) was added to the hot water from the top of the tank. In order to disperse the brightener, the contents of the tank were agitated at 64 RPM with the 30 inch (76 cm) impeller. (The 64 RPM setting was not changed throughout the total mixing cycle.) After 5 minutes of agitation, 10.11 lbs. (4.6 kg) of Calsoft$^R$ F-90 powdered $C_{12}$ sodium linear alkylbenzene sulfonate (LAS) was added from a plastic bucket at the top of the tank. Following another 5 minutes of agitation, 75° F. (24° C.) city water was added through a line at the top of the tank until a total volume of 250 gallons (946 liters) was in the tank. At this point, 5.46 lbs. (2.48 kg) of perfume was added by using a polypropylene-encased magnetic drive centrifugal pump (FASCO Model MDR-80T-G07) and ¼ inch (0.64 cm) I.D. polyethylene tubing coupled to ¼ inch (0.64 cm) I.D. PVC pipe. The perfume was added over a 5 minute period and delivered to a point at the periphery of the impeller for optimum mixing.

A 40° F. (4.4° C.) concentrated bleach solution containing 13.7% sodium hypochlorite was added to the brightener, surfactant/perfume solution in the tank. (The highly concentrated hypochlorite was stored at low temperature to maintain stability.) Bleach addition was accomplished using an air-driven drum pump (GAST Model IUP-NCC-13) and ½ inch (1.3 cm) I.D. polyethylene tubing coupled to ½ inch (1.3 cm) PVC pipe. The bleach was pumped from 55 gallon (208 liter) polyethylene drums at a constant rate of 2.0 gallons (7.6 liters) per minute of hypochlorite solution until 300 pounds (136.4 kg) of hypochlorite solution had been added to the agitated tank at the periphery of the impeller. Following addition of the first portion of the bleach, the remainder of the 1528 pounds (694.5 kg) of hypochlorite solution was added at a rate of 4.0 gallons (15.1 liters) per minute.

While maintaining a 64 RPM agitation rate, the pH of the product mixture was then adjusted to pH 12.8 with a 50% sodium hydroxide solution. A 10% suspension of Ultramarine Blue pigment (0.49 kg pigment/4.45 kg of 24° C. city water) was premixed for 30 minutes using a Gifford Wood Homogenizer Mixer (Model 1-LV). The Ultramarine Blue pigment suspension was added by using the same delivery system as was used for perfume addition. After all the suspension was pumped in, an additional 5 minutes of mixing was allowed. The composition of the finished product was as follows: 5.75% sodium hypochlorite (plus an equimolar amount of sodium chloride which was present in the hypochlorite solution), 0.05% of the optical brightener, 0.25% of LAS, 0.15% perfume, 0.03% Ultramarine Blue pigment, and the balance water.

Uniform samples were taken from the tank and observed. These samples contained a uniform dispersion composed of very small particles which were barely distinguished on close inspection, and gave the product the appearance of a continuous fluid. Some of these samples were placed in 37 cm tall covered glass graduated cylinders and stored under ambient conditions. After 5 days about 99% of the volume was a uniform opaque dispersion of precipitated brightener and surfactant and Ultramarine Blue pigment. About 1% of the volume was a clear layer at the top. Thus, the bulk of the composition had retained its uniform opaque appearance. Analysis indicated no detectable loss in sodium hypochlorite, or in brightener activity (as measured by fluoresence of the composition).

What is claimed is:

1. An aqueous composition comprising:

(a) from about 3% to about 8% sodium hypochlorite;

(b) from about 0.025% to about 0.2 % of an optical brightener having the formula:

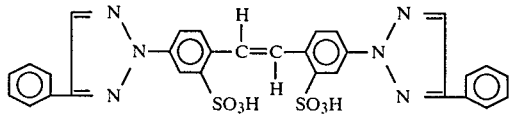

or the alkali metal salts thereof;

(c) from about 0.05% to about 2% of a surfactant selected from the group consisting of alkylaryl sulfonates having the formulas:

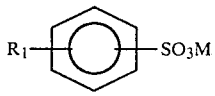

and

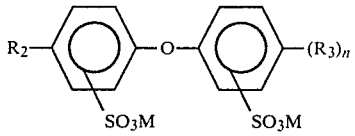

wherein $R_1$ is a $C_8$-$C_{20}$ alkyl group, $R_2$ and $R_3$ are $C_6$-$C_{16}$ alkyl groups, M is alkali metal and n is 0 or 1; and (d) at least about 80% water; wherein the brightener is present in the composition in the form of fibrous particles having fiber diameters of from about 0.01 to about 1.5 microns.

2. The composition of claim 1 additionally comprising up to about 0.5% of a perfume material which is stable against chemical attack by sodium hypochlorite.

3. The composition of claims 1 or 2 wherein the amount of sodium hypochlorite in the finished composition is from about 4% to about 6%.

4. The composition of claims 1 or 2 wherein the amount of optical brightener in the finished composition is from about 0.05% to about 0.2%.

5. The composition of claims 1 or 2 wherein the amount of surfactant in the finished composition is from about 0.2% to about 1%.

6. An aqueous composition comprising:

(a) from about 3% to about 8% sodium hypochlorite;

(b) from about 0.025% to about 0.2% of an optical brightener having the formula:

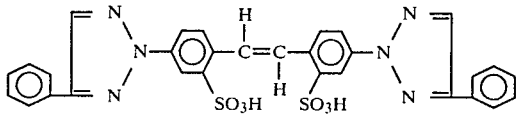

or the alkali metal salts thereof;

(c) from about 0.05% to about 2% of a surfactant selected from the group consisting of alkylaryl sulfonates having the formulas:

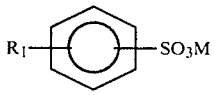

and

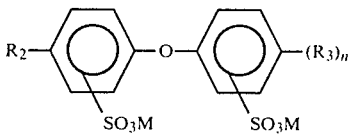

wherein $R_1$ is a $C_8$–$C_{20}$ alkyl group, $R_2$ and $R_3$ are $C_6$–$C_{16}$ alkyl groups, M is alkali metal and n is 0 or 1; and (d) at least about 80% water; wherein the brightener is present in the composition in the form of fibrous particles; the said compositions being made by a process comprising the steps of:

1. preparing an aqueous solution containing from about 0.05% to about 0.2% of the optical brightener and from about 0.1% to about 4% of the surfactant;
2. adding slowly, and with the low shear mixing, to the solution of Step 1, a sufficient amount of aqueous sodium hypochlorite to produce a final composition comprising from about 3% to about 8% sodium hypochlorite, from about 0.025% to about 0.2% optical brightener and from about 0.05% to about 2% surfactant.

7. The composition of claim 6 additionally comprising up to about 0.5% of a perfume material which is stable against chemical attack by sodium hypochlorite, wherein said perfume material is added to the aqueous solution of Step 1 after the surfactant has been added.

8. The composition of claims 6 or 7 wherein the amount of sodium hypochlorite in the finished composition is from about 4% to about 6%.

9. The composition of claims 6 or 7 wherein the amount of optical brightener in the finished composition is from about 0.05% to about 0.075%.

10. The composition of claims 6 or 7 wherein the amount of optical brightener in the finished composition is from about 0.05% to about 0.2%.

11. The composition of claims 6 or 7 wherein the amount of surfactant in the finished composition is from about 0.2% to about 1%.

12. The composition of claim 4 wherein the surfactant is selected from the group consisting of alkylaryl sulfonates having the formulas:

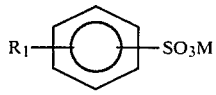

and

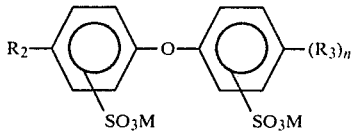

wherein $R_1$ is a $C_{11}$–$C_{13}$ alkyl group, $R_2$ and $R_3$ are $C_{10}$–$C_{12}$ alkyl groups, M is alkali metal and n is 0 or 1.

13. The composition of claim 5 wherein the surfactant is selected from the group consisting of alkylaryl sulfonates having the formulas:

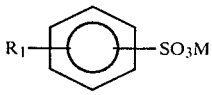

and

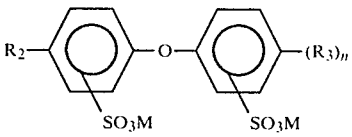

wherein $R_1$ is a $C_{11}$–$C_{13}$ alkyl group, $R_2$ and $R_3$ are $C_{10}$–$C_{12}$ alkyl groups, M is alkali metal and n is 0 or 1.

14. The composition of claim 10 wherein the surfactant is selected from the group consisting of alkylaryl sulfonates having the formulas:

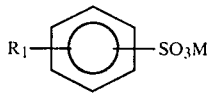

and

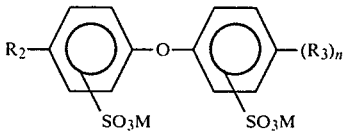

wherein $R_1$ is a $C_{11}$–$C_{13}$ alkyl group, $R_2$ and $R_3$ are $C_{10}$–$C_{12}$ alkyl groups, M is alkali metal and n is 0 or 1.

15. The composition of claim 11 wherein the surfactant is selected from the group consisting of alkylaryl sulfonates having the formulas:

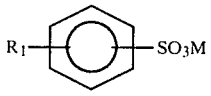

and

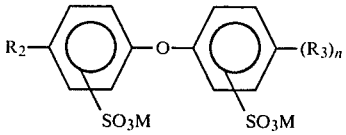

wherein $R_1$ is a $C_{11}$–$C_{13}$ alkyl group, $R_2$ and $R_3$ and $C_{10}$–$C_{12}$ alkyl groups, M is alkali metal and n is 0 or 1.

* * * * *